US010413023B2

(12) United States Patent
Hsu et al.

(10) Patent No.: US 10,413,023 B2
(45) Date of Patent: Sep. 17, 2019

(54) SLIDER FOR SLIDE FASTENER

(71) Applicant: YKK Corporation, Tokyo (JP)

(72) Inventors: Hsien Hsiang Hsu, Taipei (TW); Yuichi Iwase, Taipei (TW)

(73) Assignee: YKK Corporation (JP)

( * ) Notice: Subject to any disclaimer, the term of this patent is extended or adjusted under 35 U.S.C. 154(b) by 60 days.

(21) Appl. No.: 15/553,055

(22) PCT Filed: Feb. 25, 2015

(86) PCT No.: PCT/JP2015/055457
§ 371 (c)(1),
(2) Date: Aug. 23, 2017

(87) PCT Pub. No.: WO2016/135897
PCT Pub. Date: Sep. 1, 2016

(65) Prior Publication Data

US 2018/0027930 A1 Feb. 1, 2018

(51) Int. Cl.
*A44B 19/26* (2006.01)
*A44B 19/42* (2006.01)

(52) U.S. Cl.
CPC ..... *A44B 19/262* (2013.01); *A44B 19/26* (2013.01); *A44B 19/42* (2013.01); *Y10T 24/2586* (2015.01)

(58) Field of Classification Search
CPC ..... Y10T 24/2586; Y10T 24/2568; Y10T 24/2561; A44B 19/262; A44B 19/305; A44B 19/26
See application file for complete search history.

(56) References Cited

U.S. PATENT DOCUMENTS 3,854,175 A 12/1974 Yoshida
5,187,841 A 2/1993 Takemura et al.
5,956,819 A 9/1999 Terasaki et al.
(Continued)

FOREIGN PATENT DOCUMENTS

GB 1201522 A 8/1970
JP 4-261604 A 9/1992
(Continued)

OTHER PUBLICATIONS

International Search Report, PCT Patent Application No. PCT/JP2015/055457, dated May 19, 2015.
(Continued)

*Primary Examiner* — Robert Sandy
*Assistant Examiner* — Michael S Lee
(74) *Attorney, Agent, or Firm* — Kilpatrick Townsend & Stockton LLP

(57) ABSTRACT

A slider may include a slider body, a pull-tab attachment portion provided at the slider body, and a resin-made pull tab attached to the pull-tab attachment portion. The pull tab may include an axial portion and a pair of bars extending from respective ends of the axial portion. The pull-tab attachment portion may include a pair of claws that axially support the axial portion of the pull tab. Each claw may be held by and between the respective paired bars while the pull tab pivots. A width of a terminal end of each claw in an axial direction of the axial portion may be less than a width of a base end of each claw in the axial direction.

21 Claims, 13 Drawing Sheets

(56) References Cited

U.S. PATENT DOCUMENTS

| | | | | |
|---|---|---|---|---|
| 6,588,072 | B1 * | 7/2003 | Lin | A44B 19/265 24/416 |
| 6,851,162 | B2 | 2/2005 | Yuki et al. | |
| 8,453,302 | B2 | 6/2013 | Keyaki et al. | |
| 9,271,548 | B2 | 3/2016 | Keyaki et al. | |
| 2003/0182774 | A1 * | 10/2003 | Lin | A44B 19/305 24/436 |
| 2005/0102803 | A1 | 5/2005 | Wen et al. | |
| 2007/0277354 | A1 | 12/2007 | Jung | |
| 2008/0252461 | A1 * | 10/2008 | Sugata | G06K 7/10178 340/572.7 |
| 2014/0310923 | A1 | 10/2014 | Matsushima | |

FOREIGN PATENT DOCUMENTS

| | | | |
|---|---|---|---|
| JP | 2005-211200 | A | 1/2004 |
| JP | 2005-144000 | A | 6/2005 |
| JP | 2007-054176 | A | 3/2007 |
| JP | 2010-119559 | A | 6/2010 |
| JP | 3160840 | U | 6/2010 |
| JP | 3196059 | U | 2/2015 |
| WO | 2009/130771 | A1 | 10/2009 |
| WO | 2011/013246 | A1 | 2/2011 |

OTHER PUBLICATIONS

International Preliminary Report on Patentability, PCT Patent Application No. PCT/JP2015/055457, dated Sep. 8, 2017.

Office Action, Japanese Patent Application No. 2018-043165, dated Jan. 8, 2019.

U.S. Appl. No. 15/926,354, Non-Final Office Action, dated Apr. 19, 2019, 11 pages.

* cited by examiner

SLIDER FOR SLIDE FASTENER

This application is a national stage application of PCT/JP2015/055457, which is incorporated herein by reference.

TECHNICAL FIELD

The present disclosure relates to a slider for slide fastener.

BACKGROUND ART

Patent literature 1 discloses a slider for hidden slider fastener. A pull tab is coupled to a slider body via a pull-tab attachment column.

Patent literature 2 discloses a configuration in which a pull tab is held to be a laid state when the pull tab has been laid down frontward or rearward onto an upper wing of a slider. Projections projecting inwardly in the width direction are provided at respective paired legs in the pull tab. These projections are in contact with the pull-tab attachment column when the pull tab is laid down.

Patent literature 3 discloses that a pull tab made of soft resin material is attached to a body made of metal through injection molding. An axial portion is provided at one of the body and the pull tab, and an orifice portion is provided at the other one to which the axial portion is inserted. The inner periphery of the orifice portion and the outer periphery of the axial portion contact one another.

Patent literature 4 discloses a technique to push a tab for slide faster onto a slide so that the tab is secured to at least one stable position relative to a cursor.

CITATION LIST

Patent Literature

[PTL 1] Japanese Patent Application Laid-open No. 2007-54176

[PTL 2] Registered Japanese Utility-model application No. 3160840

[PTL 3] Japanese Patent Application Laid-open No. 2005-211200

[PTL 4] Japanese Patent Application Laid-open No. 4-261604

SUMMARY OF INVENTION

Technical Problem

The present inventors have newly recognized the meaningfulness of ensuring easier attachment of pull tab and maintaining more stable pivoting posture of pull tab while the pull tab pivots.

Solution to Problem

A slider for slide fastener according to an aspect of the present invention may be a slider for slide fastener that comprises:

- a slider body;
- a pull-tab attachment portion provided at the slider body;
- a resin-made pull tab attached to the pull-tab attachment portion, the pull tab including an axial portion and a pair of bars extending from respective ends of the axial portion, wherein
- the pull-tab attachment portion includes a pair of claws that axially support the axial portion of the pull tab,

- each claw is held by and between the respective paired bars while the pull tab pivots, and
- a width of a terminal end of each claw in an axial direction of the axial portion is less than a width of a base end of each claw in the axial direction.

In some embodiments, the pair of bars grip at least one of the pair of claws throughout the pivoting of the pull tab.

In some embodiments, while the pull tab pivots, the pair of bars pass through a boundary between the terminal ends of the claws which are arranged to face one another above the axial portion.

In some embodiment, the pair of bars are arranged to have a first interspace, and a width of a terminal end of each claw in the axial direction is less than the first interspace.

In some embodiments, a power required to pivot the pull tab at an upright state is less than a power required to pivot the pull tab at a laid state, in accordance with decreasing width of each claw in the axial direction between the base end and the terminal end.

In some embodiments, a width of each claw in the axial direction continuously decreases from the base end toward the terminal end of each claw.

In some embodiments, each terminal end of each claw has a first corner which is rounded and is positioned at a side of a first end of the axial portion of the pull tab, and a second corner which is rounded and is positioned at a side of a second end of the axial portion of the pull tab.

In some embodiments, the slider body comprises:

- a lower wing:
- a pair of left and right walls provided at left and right side edge portions of the lower wing;
- a pair of left and right flanges inwardly extending from the upper end of the wall in left and right direction;
- a guide column provided at a side of a front end of the lower wing; and
- a top plate provided at the upper end of the guide column and projected rearward therefrom, wherein
- the pull-tab attachment portion is provided on the top plate.

In some embodiments, the pull tab further comprises a gripped portion to which the paired bars are coupled, wherein the gripped portion is provided in non-planar manner so as to be angled relative to an extending direction of the paired bars.

A slide fastener according to another aspect of the present invention comprises:

- a pair of left and right fastener stringers in which fastener elements are provided at side edge portions of fastener tapes; and
- a slider, as featured above, for engaging and disengaging the left and right fastener elements.

A slider for slide fastener according to another aspect of the present invention may be a slider for slide fastener that comprises:

- a slider body;
- a pull-tab attachment portion provided at the slider body;
- a resin-made pull tab attached to the pull-tab attachment portion, the pull tab including an axial portion having a circular cross section and a pair of bars extending from respective ends of the axial portion, wherein
- the pull-tab attachment portion includes a pair of claws that are arranged to face one another in order to axially support the axial portion of the pull tab, and a mount surface provided between the paired claws and onto which the axial portion is placed, and wherein
- the axial portion is held at three points of facing surfaces of the respective paired claws and the mount surface.

Advantageous Effects of Invention

According to the exemplary aspects of the present invention, it may be achieved to ensure easier attachment of pull tab and to maintain more stable pivoting posture of pull tab while the pull tab pivots.

BRIEF DESCRIPTION OF DRAWINGS

FIG. 4 is a schematic process view of a slider according to an aspect of the present invention, with FIG. 4(*a*) schematically illustrating a preform at which claws have been not yet swaged and FIG. 4(*b*) schematically illustrating a slider at which the claws have been swaged.

DESCRIPTION OF EMBODIMENTS

Hereinafter, non-limiting exemplary embodiments of the present invention will be described with reference to Figures. One or more disclosed embodiments and each feature included therein are not mutually exclusive. Without requiring excess descriptions, a skilled person could properly combine the respective embodiments and/or the respective features and could understand the synergic effects by such combinations. Overlapping descriptions among embodiments will be basically omitted. Referenced figures are mainly for the purpose of illustrating the invention and may be simplified for the sake of convenience of preparing figures.

Figure 1:
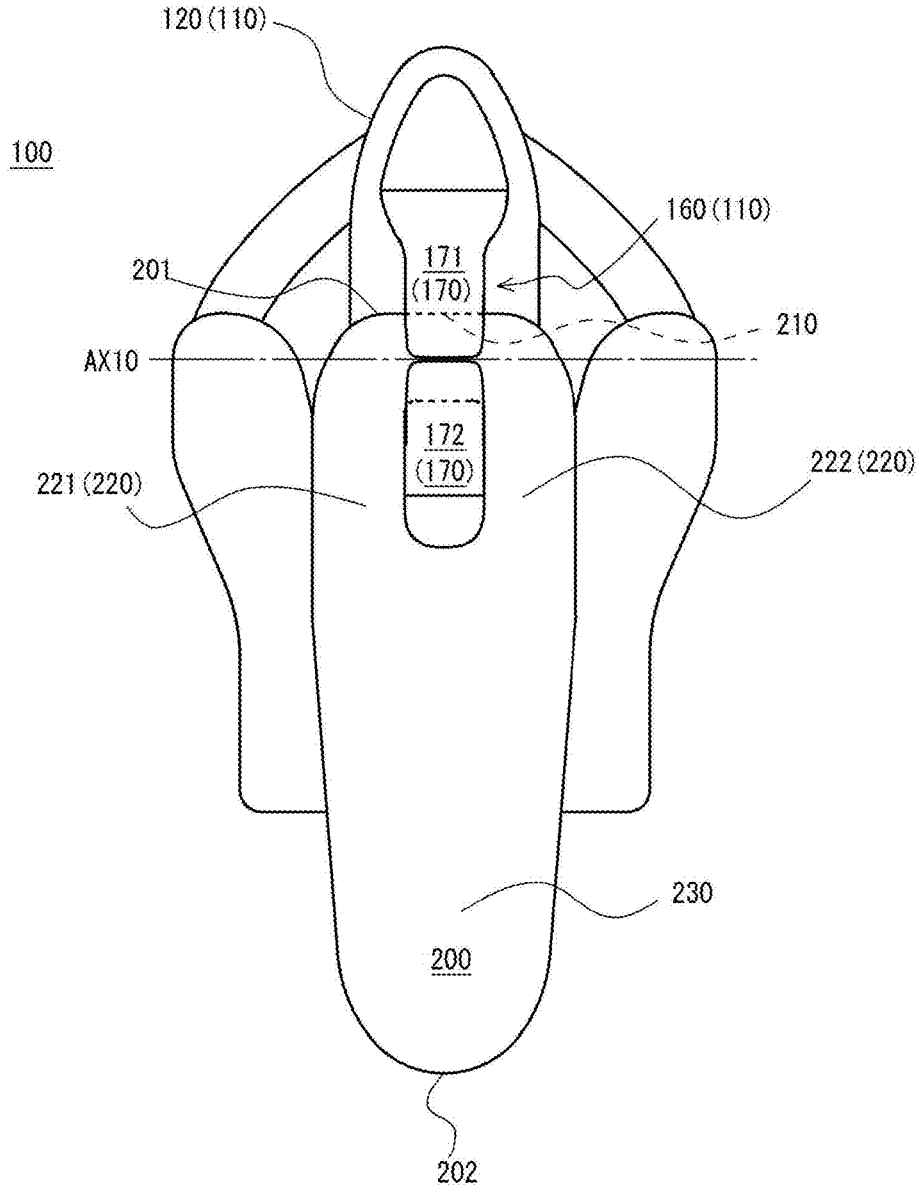
FIG. 1 is a schematic top view of a slider according to an aspect of the present invention, showing a pull tab having been laid down rearward.
Figure 2:
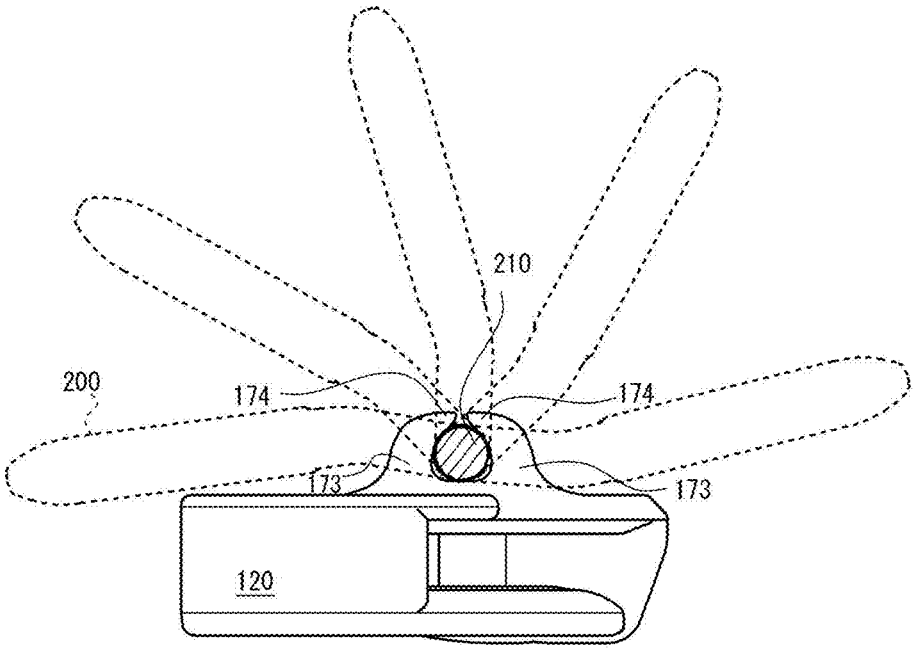
FIG. 2 is a schematic side view schematically showing pivoting of a pull tab of a slider according to an aspect of the present invention, wherein an axial portion of a pull tab is schematically shown in section, and pull tabs at different pivoting positions are schematically shown by dotted lines. A pull tab laid down frontward, a pull tab laid down rearward, a pull tab at upright state, a pull tab tilted obliquely frontward, and a pull tab tilted obliquely rearward are schematically shown by dotted lines. The pull tab can hold its posture at these all 5 postures.
Figure 3:
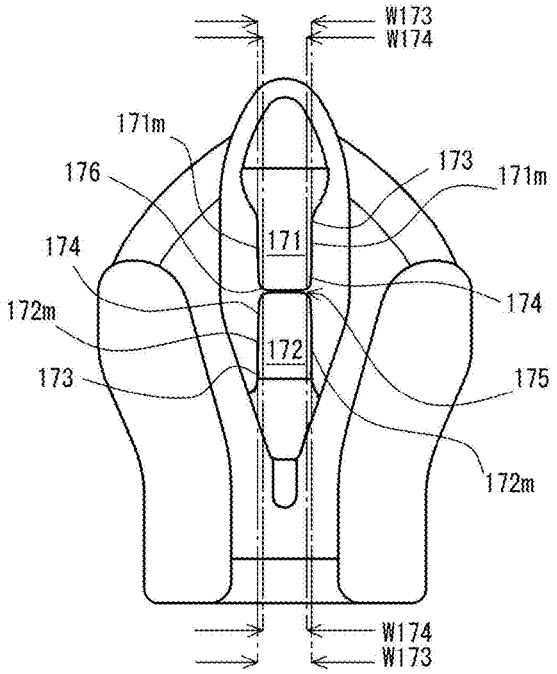
FIG. 3 is a schematic top view of a slider according to an aspect of the present invention wherein a pull tab has been detached from a pull-tab attachment portion of a slider body, for the sake of illustration. An upper section of the figure illustrates a schematic top view of a slider and a lower section of the figure illustrates a top view of a part of a pull tab.
Figure 3:
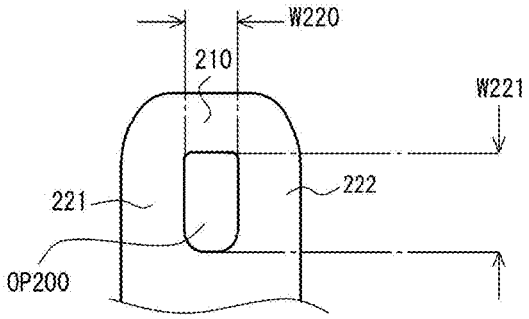
Figure 4A:
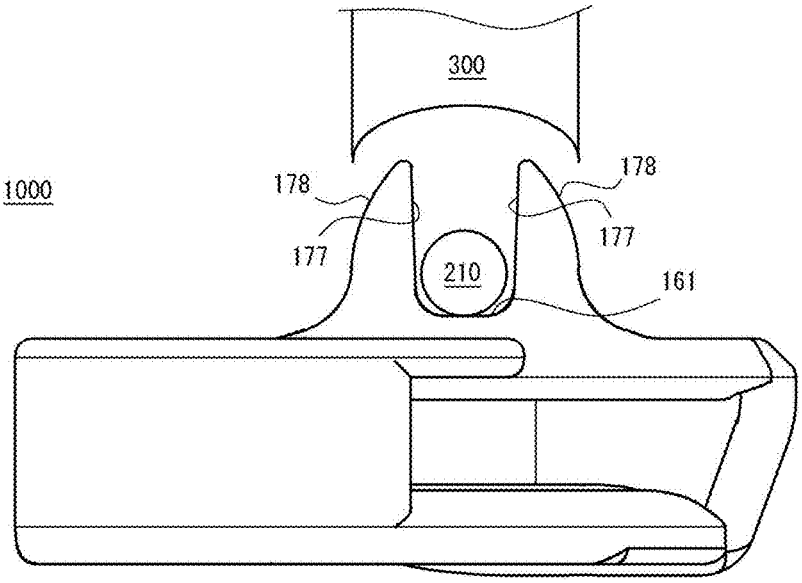
FIGS. 4(*a*) and 4(*b*) are collectively referred to herein as FIG. 4.
Figure 4B:
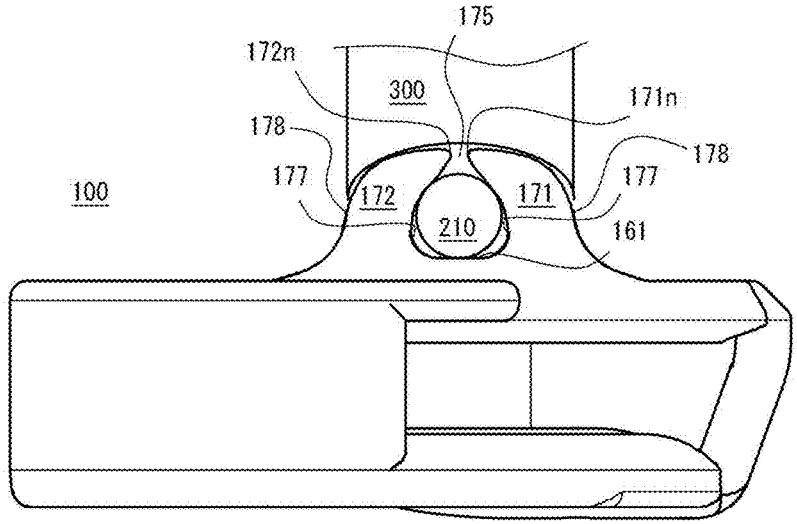
Figure 5:
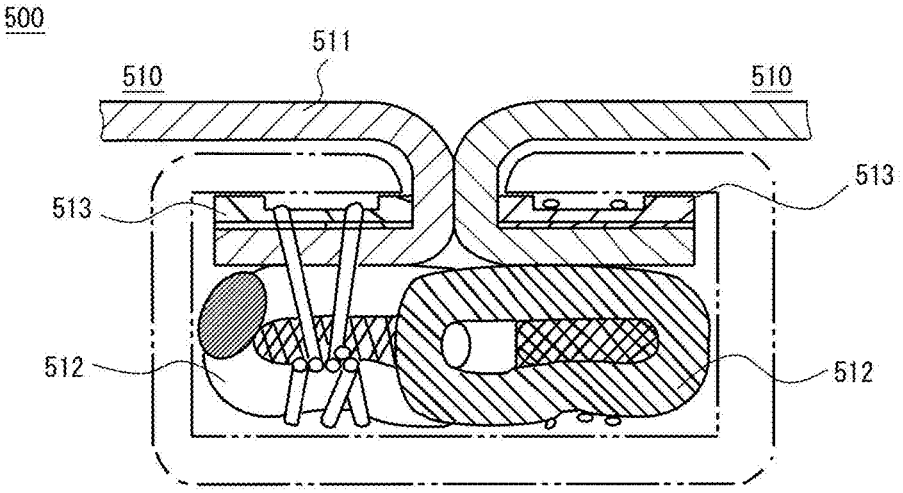
FIG. 5 is a schematic sectional view of a hidden slider fastener according to an aspect of the present invention, schematically illustrating an example of a section around a rear end portion of a slider.
Figure 6:
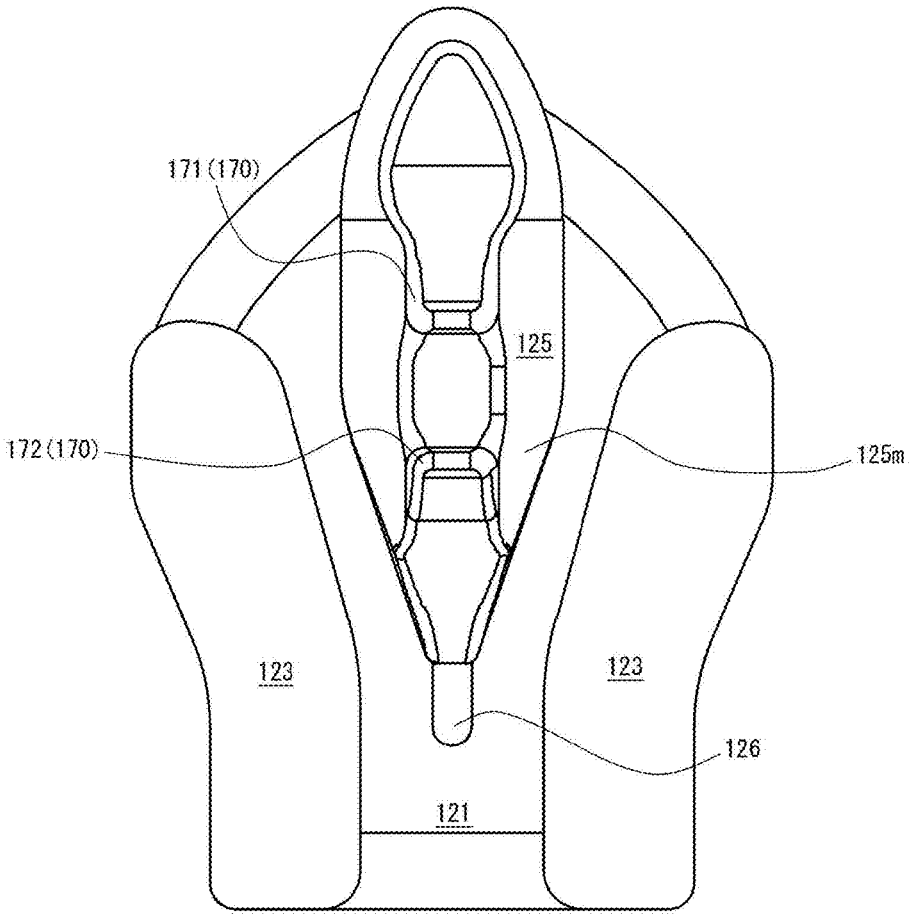
FIG. 6 is a schematic top view of a slider body before claws are swaged according to an aspect of the present invention, showing that each claw extends upward in straight before being swaged.
Figure 7:
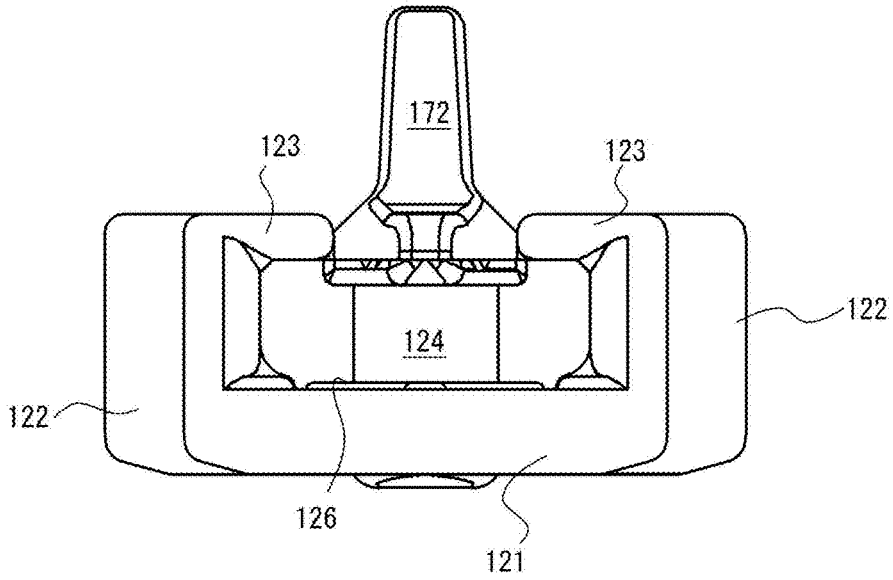
FIG. 7 is a schematic side view of a slider body before claws being swaged according to an aspect of the present invention.
Figure 8:
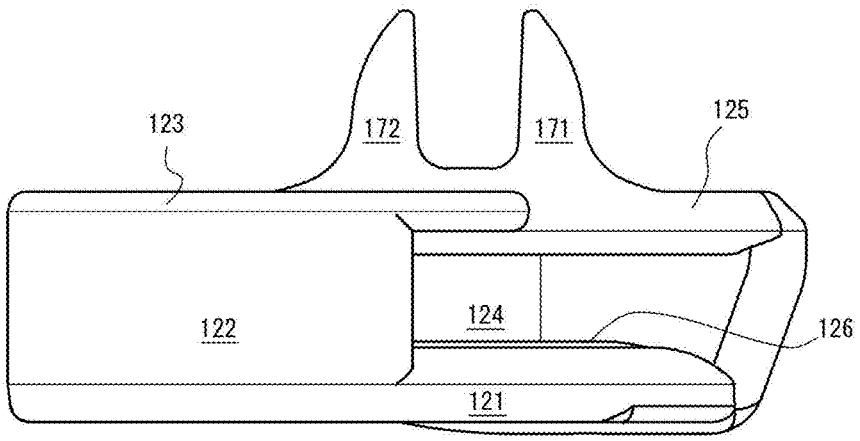
FIG. 8 is a schematic side view of a slider body before claws are swaged according to an aspect of the present invention, showing that each claw extends upward in straight before being swaged.
Figure 9:
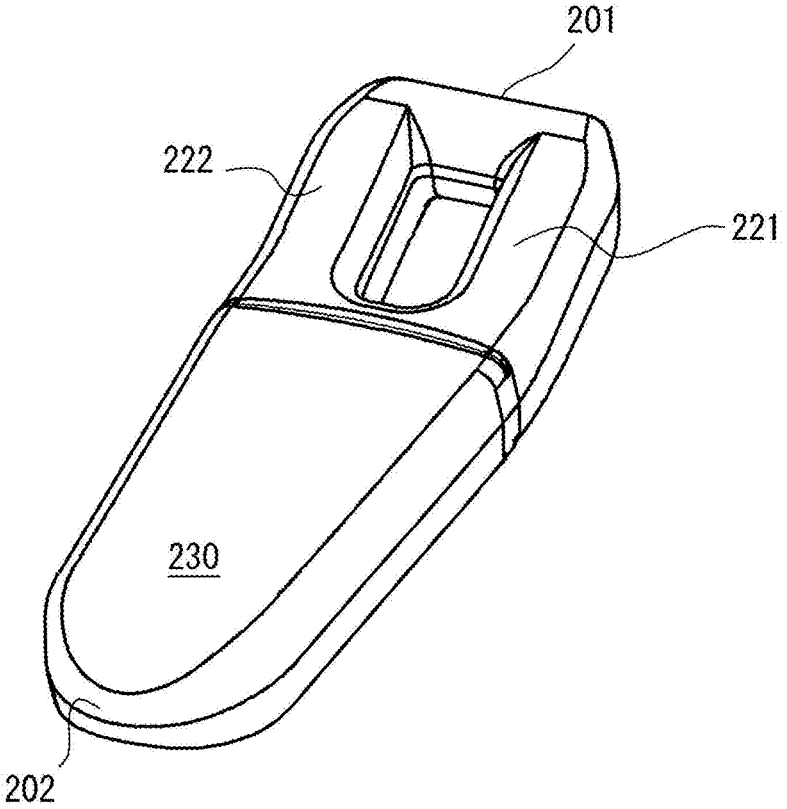
FIG. 9 is a schematic perspective view of a pull tab of a slider according to an aspect of the present invention.
Figure 10:
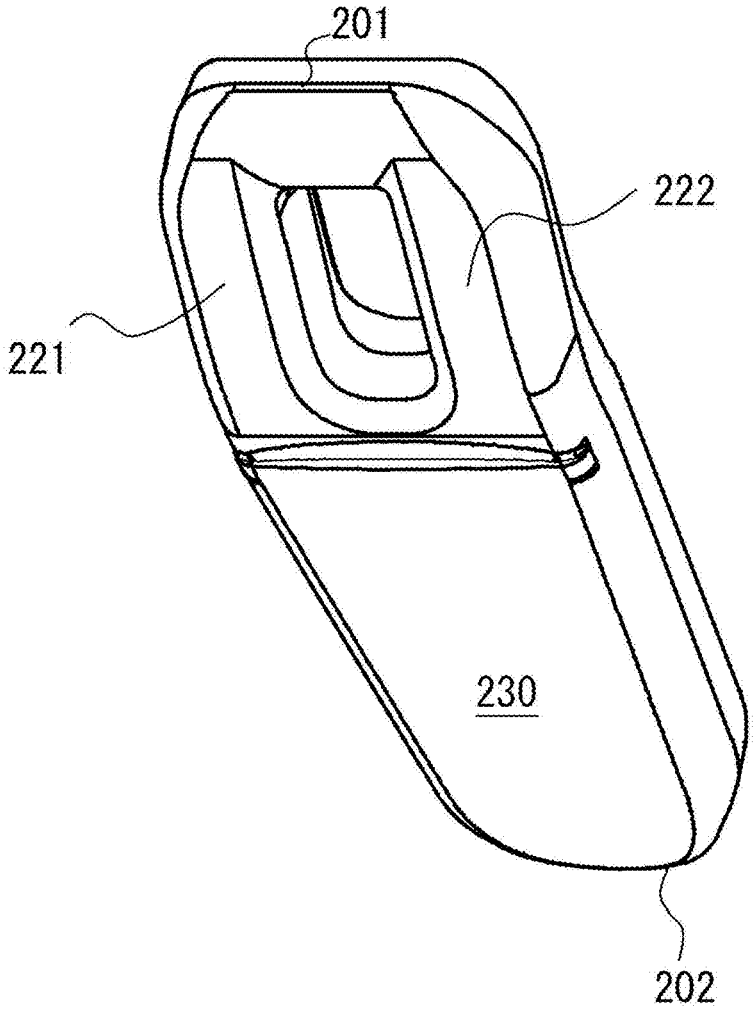
FIG. 10 is a schematic perspective view of a pull tab of a slider according to an aspect of the present invention, obliquely viewing the pull tab from the opposite side of FIG. 9.
Figure 11:
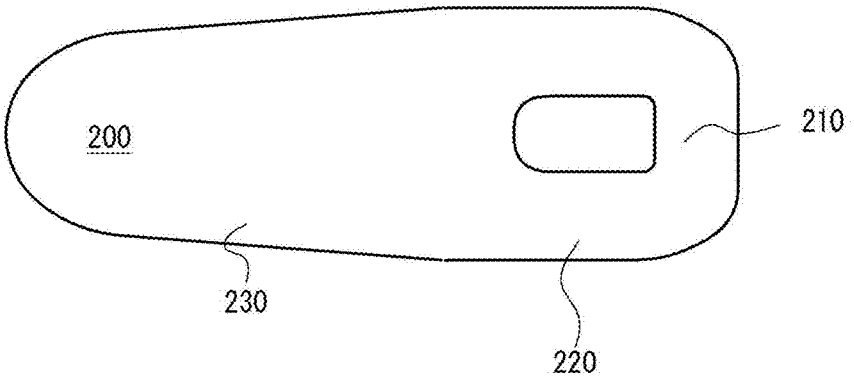
FIG. 11 is a schematic front view of a pull tab of a slider according to an aspect of the present invention.
Figure 12:
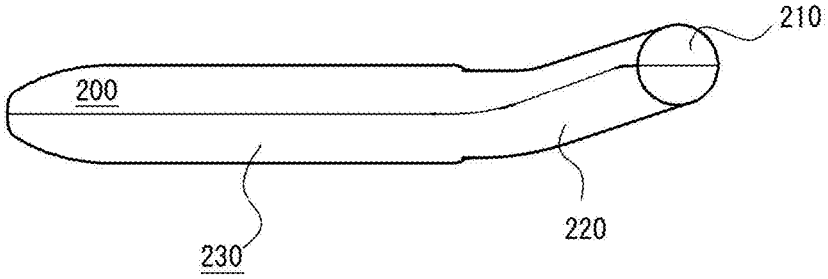
FIG. 12 is a schematic side view of a pull tab of a slider according to an aspect of the present invention.

Descriptions will be made for non-limiting exemplary embodiments of the present invention with reference to FIGS. 1-12. FIG. 1 is a schematic top view of a slider, showing a pull tab having been laid down rearward. FIG. 2 is a schematic side view schematically showing pivoting of a pull tab of a slider, wherein an axial portion of a pull tab is schematically shown in section, and pull tabs at different pivoting positions are schematically shown by dotted lines. A pull tab laid down frontward, a pull tab laid down rearward, a pull tab at upright state, a pull tab tilted obliquely frontward, and a pull tab tilted obliquely rearward are schematically shown by dotted lines. The pull tab can hold its posture at these all 5 postures. FIG. 3 is a schematic top view of a slider wherein a pull tab has been detached from a pull-tab attachment portion of a slider body, for the sake of illustration. An upper section of the figure illustrates a schematic top view of a slider and a lower section of the figure illustrates a top view of a part of a pull tab. FIG. 4 is a schematic process view of a slider, with (a) schematically illustrating a preform at which claws have been not yet swaged and (b) schematically illustrating a slider at which the claws have been swaged. FIG. 5 is a schematic sectional view of a hidden slider fastener, schematically illustrating an example of a section around a rear end portion of a slider. FIG. 6 is a schematic top view of a slider body before claws are swaged, showing that each claw extends upward in straight before being swaged. FIG. 7 is a schematic side view of a slider body before claws being swaged. FIG. 8 is a schematic side view of a slider body before claws are swaged, showing that each claw extends upward in straight before being swaged. FIG. 9 is a schematic perspective view of a pull tab of a slider. FIG. 10 is a schematic perspective view of a pull tab of a slider, obliquely viewing the pull tab from the opposite side of FIG. 9. FIG. 11 is a schematic front view of a pull tab of a slider. FIG. 12 is a schematic side view of a pull tab of a slider.

Hereinafter, front-rear direction, left-right direction, and up-down direction may be defined as follows. The following definitions are presented for the sake of improving the clarity of the disclosure of specification, and thus it should be noted that these should not be relied on for narrowly construing the claimed invention.

The front-rear direction may match a direction of movement of a slider for opening and closing left and right fastener stringers. Frontward movement of a slider closes the left and right fastener stringers, i.e. left and right fastener elements shift to a coupled state. Rearward movement of a slider opens the left and right fastener stringers, i.e. left and right fastener elements shift to a decoupled state. The left-right direction may be a direction orthogonal to the front-rear direction and orthogonal to a guide column or coupling column of a slider. The up-down direction may be a direction orthogonal to the front-rear direction and the left-right direction. The up-down direction may be parallel to a guide column or a coupling column of a slider.

As would be understood from FIGS. 1-12, particularly from FIG. 5, an illustrated exemplary slider 100 may be a slider for hidden slide fastener. It should be noted that the present invention should not be limited to a slider for hidden slide fastener. In other embodiments, the slider 100 may be configured to be a slider at least including an upper wing, a lower wing, and a coupling column coupling the front end of the upper wing and the front end of the lower wing. This example is disclosed in the patent literatures 2 and 3 which are incorporated herein by references.

The slider 100 has a slider main-body 110 and a pull tab 200. The slider main-body 110 includes a slider body 120 and a pull-tab attachment portion 160 provided onto the slider body 120. The pull tab 200 may be attached to the pull-tab attachment portion 160.

The slider body 120 is configured to guide left and right fastener elements and to allow the left and right fastener elements to couple and to be decoupled while being guided by the slider body 120. The upper surface of the slider body 120 is provided with the pull-tab attachment portion 160. The pull-tab attachment portion 160 is integrally provided to the slider body 120, but not necessarily limited to. In other embodiments, the pull-tab attachment portion 160 may be separable from the slider body 120, and may be attached to the slider body 120.

Both of the slider body 120 and the pull-tab attachment portion 160 may be made of metal, and the pull tab 200 may be made of resin. The pull tab 200 may be relatively softer compared to the slider body 120 and the pull-tab attachment portion 160. As would be understood by a skilled person in the art, a process of manufacturing the slider 100 can involve a process of die-casting, a process of injection-molding, and a process of swaging.

The pull tab 200 may be an elongated member having a base end 201 and a free end 202. The pull tab 200 may have an axial portion 210, a pair of bars 220 extending from respective ends of the axial portion 210, and a gripped portion 230 coupled to the paired bars 220. The axial portion 210 may be shaped to be circular in section, and may elastically deform by being pressed by facing surfaces 177 of the respective claws 170 and a mount surface 161 as described below.

More specifically, the axial portion 210 extends in the left-right direction and extends along a pivotal axis AX10 of the pull tab 200. The axial direction of the axial portion 210 may match the pivotal axis AX10 of the pull tab 200. In the illustrated example, the axial direction of the axial portion 210 matches the left-right direction, but the axial direction of the axial portion 210 may possibly match other directions such as the front-rear direction in other embodiments.

The pair of bars 220 includes a left bar 221 coupled to the left end of the axial portion 210 and a right bar 222 coupled to the right end of the axial portion 210. The left bar 221 and the right bar 222 extend substantially parallel to a direction directed away from the axial portion 210 and a direction directed away from the pivotal axis AX10 of the pull tab 200. As shown in FIG. 3, a first interspace W220 is provided between the left bar 221 and the right bar 222. A second interspace W221 is provided between the axial portion 210 and the gripped portion 230.

The left bar 221 and the right bar 222 are arranged to have the first interspace W220 along the pivotal axis AX10. In a direction orthogonal to the pivotal axis AX10, the second interspace W221 is provided between the axial portion 210 and the gripped portion 230. The second interspace W221 is greater than the first interspace W220.

The pull tab 200 may be provided with an opening OP200 which is surrounded by the axial portion 210, the left and right bars 220, and the gripped portion 230. The open width of the opening OP200 in the left-right direction matches the first interspace W220 of the above-described left and right bars 220. The opening OP200 has an open length that matches the second interspace W221 between the axial portion 210 and the gripped portion 230. The opening OP200 may be elongated in a direction directed away from the axial portion 210, thus avoiding interference with claws 170 described later which axially support the axial portion 210. The claws 170 may extend through the opening OP200 having the first interspace W220 between the paired bars 220 and the second interspace W221 between the axial portion 210 and the gripped portion 230.

The gripped portion 230 may be a plate provided in non-planar manner so as to be angled relative to the extending direction of the paired bars 220. The gripped portion 230 may be gripped by a human for moving the slider 100 forward or rearward. For moving the slider 100 frontward, the gripped portion 230 may be gripped by a human and the pull tab 200 may be inclined obliquely frontward. For moving the slider 100 rearward, the gripped portion 230 may be gripped by a human and the pull tab 200 may be inclined obliquely rearward. When the pull tab 200 has been laid down frontward, the gripped portion 230 extends obliquely frontward relative to the slider body 120, and the gripped portion 230 does not touch the upper surface of the slider body 120, forming an interspace therebetween. This feature may suppress or ease an interference, in the hidden slide fastener, between the gripped portion 230 and a fastener tape which is curbed and fixed in U-shape.

Any shape of the pull tab 200 will be possible and the illustrated example should not be viewed as limitations. In other embodiments, the gripped portion 230 may be provided with one or more arbitrary sized openings. In other embodiments, the opening OP200 may extend to closely nearby the free end 202 of the pull tab 200 so that the pull tab 200 is shaped like a center-opened frame.

In the illustrated example, the respective bars 220 extend in parallel so that the left-right width of the paired bars 220 is roughly constant in the direction directed away from the axial portion 210. The left-right width of the gripped portion 230 may gradually decrease as extending away from the axial portion 210 and the terminal end of the gripped portion 230 is rounded. These features may be replaced by other features in other embodiments.

The above-described pull-tab attachment portion 160 may include a pair of claws 170 which axially support the axial portion 210 of the pull tab 200. The pull-tab attachment portion 160 may include a pair of adjacent claws 170 sandwiching the axial portion 210 of the pull tab 200. In the illustrated example, the pair of claws 170 are arranged in the front-rear direction so that front-claw 171 and rear-claw 172 are provided. The pair of claws 170 are arranged, on the slider body 120, to face one another. An interspace is provided between the paired claws 170 which decreases as being away from the slider body 120. Note that, an interspace between the paired claws before being swages shown in FIG. 4(*a*) is maintained to be constant in the up-down direction.

The pull-tab attachment portion 160 may have a mount surface 161 between the paired claws 170 on which the axial portion 210 is placed. The mount surface 161 may be a surface which matches the upper surface of the slider body 120 or which is upwardly positioned from the upper surface of the slider body 120. The mount surface 161 may be substantially flat and may not be greatly deformed even during the claws 170 shown in FIG. 4 is plastically deformed.

Each claw 170 has a facing surface 177 which faces the other claw 170 and an opposite surface 178 opposite to the facing surface 177. The facing surface 177 of the front-claw 171 rises up from the front end of the mount surface 161 and approaches closer to the rear-claw 172 as extending upward. The facing surface 177 of the rear-claw 172 rises up from the rear end of the mount surface 161 and approaches closer to the front-claw 171 as extending upward. That is, the facing surfaces 177 of the respective claws 170 approach closer one another as extending away from the slider body 120. The axial portion 210 of the pull tab 200 is held at three points by the three surfaces of the mount surface 161, the facing surface 177 of the front-claw 171, and the facing surface 177 of the rear-claw 172.

The facing surface 177 of the front-claw 171 and the facing surface 177 of the rear-claw 172 are arranged to be opposed in parallel before the claws are swaged, but they are arranged to be opposed in non-parallel after the claws have been swaged.

A curved surface which is smoothly curved exists between the facing surface 177 of the front-claw 171 and the mount surface 161, a curved surface which is smoothly curved exists between the facing surface 177 of the rear-claw 172 and the mount surface 161, and these curved surfaces are arranged to face one another.

The thickness of each claw 170 is defined between the facing surface 177 and the opposite surface 178 of each claw 170. The thickness of the claw 170 is reduced at the side of the terminal end of the claw 170, and the terminal end of the claw 170 is rounded when it is viewed along the pivotal axis AX10 as schematically shown in FIGS. 2 and 4(*b*).

Each claw 170 stands on the upper surface of the slider body 120. The front-claw 171 is curved rearward as extending upward from the upper surface of the slider body 120. The rear-claw 172 is curved frontward as extending upward from the upper surface of the slider body 120. As such, the axial portion 210 of the pull tab 200 is axially supported between the paired claws 170. The axial portion 210 of the pull tab 200 is prevented, over the slider body 120, by the pair of claws 170 to move in a direction away from the slider body 120 such as moving upward, moving frontward, and moving rearward. Again, in other embodiments, the pair of claws 170 may possibly be arranged in the left-right direction, not in the front-rear direction.

Each claw 170 has a base 173 and a terminal end 174. The base 173 of the claw 170 may alternatively be referred to as a lower portion of the claw 170, and the terminal end 174 of the claw 170 may alternatively be referred to as an upper portion of the claw 170. The base 173 of the claw 170 may be coupled to the slider body 120. The axial portion 210 of the pull tab 200 is arranged between the respective bases 173 of the paired claws 170. The terminal end 174 of each claw 170 is arranged above the axial portion 210. The terminal end 174 of one claw 170 and the terminal end 174 of the other claw 170 are arranged closely to face one another above the axial portion 210. In some embodiments, the respective terminal ends 174 of the claws 170 are in contact one another above the axial portion 210. As the claws 170 are plastically deformed by being swaged, it is expected that there may be a variation in interspace between the respective terminal ends 174 of the claws 170.

Each claw 170 may have different left-right widths at different positions in its extending direction. In particular, the base 173 of each claw 170 may be sized greater. The terminal end 174 of each claw 170 may be sized narrowly. Particularly, W173>W174 may be satisfied in which W173 indicates a width of the base 173 of the claw 170 in the left-right direction, and W174 indicates a width of the terminal end 174 of the claw 170 in the left-right direction. Note that, the width in the left-right direction may be identical to a width in the axial direction of the axial portion 210.

In some embodiments, the claw 170 may extend away from the slider body 120 while maintaining constant left-right width. In some embodiments, the left-right width of the claw 170 may gradually decrease as the claw 170 extends away from the slider body 120. Additionally or alternatively to the above-mentioned respective cases, the left and right corners 176 at the terminal end 174 of the claw 170 may be rounded so that the terminal end width of the claw 170 is continuously reduced compared to the base end width. In the illustrated example, the left-right width of the terminal end 174 of the claw 170 is reduced from W173 to W174 due to the left and right rounded corners 176. Note that the left corner 176 is positioned above or nearby the left end of the axial portion 210 and the right corner 176 is positioned above or nearby the right end of the axial portion 210. Note that the left end of the axial portion 210 may be named as a first end, and the right end of the axial portion 210 may be named as a second end. The left corner 176 may be named as a first corner, and the right corner 176 may be named as a second corner.

The left corner 176 of the front-claw 171 exists between the left surface 171*m* of the front-claw 171 and the terminal surface 171*n* of the front-claw 171. The right corner 176 of the front-claw 171 exists between the right surface 171*m* of the front-claw 171 and the terminal surface 171*n* of the front-claw 171. Note that the left surface 171*m* of the front-claw 171 is included in a first plane orthogonal to the pivotal axis AX10. The right surface 171*m* of the front-claw 171 is included in a second plane orthogonal to the pivotal axis AX10, and the second plane is parallel to the first plane.

The left corner 176 of the front-claw 171 may be identical to a rim between the left surface 171*m* of the front-claw 171 and the terminal surface 171*n* of the front-claw 171. The right corner 176 of the front-claw 171 may be identical to a rim between the right surface 171*m* of the front-claw 171 and the terminal surface 171*n* of the front-claw 171.

The left corner 176 of the rear-claw 172 exists between the left surface 172*m* of the rear-claw 172 and the terminal surface 172*n* of the rear-claw 172. The right corner 176 of the rear-claw 172 exists between the right surface 172*m* of the rear-claw 172 and the terminal surface 172*n* of the rear-claw 172. Note that the left surface 172*m* of the rear-claw 172 is included in the above-indicated first plane orthogonal to the pivotal axis AX10. The right surface 172*m* of the rear-claw 172 is included in the above-indicated second plane orthogonal to the pivotal axis AX10.

The left corner 176 of the rear-claw 172 may be identical to a rim between the left surface 172*m* of the rear-claw 172 and the terminal surface 172*n* of the rear-claw 172. The right corner 176 of the rear-claw 172 may be identical to a rim between the right surface 172*m* of the rear-claw 172 and the terminal surface 172*n* of the rear-claw 172.

As described above, each claw 170 may be held by and between the paired bars 220 of the pull tab 200. The base 173 of each claw 170 may be held by and between the paired bars 220 of the pull tab 200. Specifically, when the pull tab 200 is moved frontward, the front-claw 171 is held by and between the paired bars 220. When the pull tab 200 is moved rearward, the rear-claw 172 is held by and between the paired bars 220.

Note that, when the claw 170 is held by and between the paired bars 220, the left bar 221 touches the left side portion of the claw 170, and the right bar 222 touches the right side portion of the claw 170. When the claw 170 is held by and between the paired bars 220, it is expected that the paired bars 220 may slightly bend. When the claw 170 is held by and between the paired bars 220, it is expected that the interspace between the paired bars 220 may slightly increase.

In some embodiments, the terminal end 174 of each claw 170 is held by and between the paired bars 220 of the pull tab 200. In some embodiments, the terminal end 174 of each claw 170 is not held by and between the paired bars 220 of the pull tab 200.

In some embodiments, W173>W220 may be satisfied in which W173 indicates a width of the base 173 of the claw 170 in the left-right direction, and W220 indicates an interspace between the paired bars 220 of the pull tab 200 in the left-right direction. In some embodiments, additionally to that condition, W174≤W220 may be satisfied in which W174 indicates a width of the terminal end 174 of the claw 170 in the left-right direction, and W220 indicates an interspace between the paired bars 220 of the pull tab 200 in the left-right direction.

In other embodiments, W174≤W220 is not satisfied. In this instance, W174>W220 is satisfied in which W174 indicates a width of the terminal end 174 of the claw 170 in the left-right direction, and W220 indicates an interspace between the paired bars 220 of the pull tab 200 in the left-right direction.

In some embodiments in which W173>W220 and W174>W220 are satisfied, |W173-W220|>|W174-W220| may be satisfied.

The left-right width of the claw 170 gradually changes as the claw 170 extends. Therefore, in some embodiments, the pair of bars 220 grip at least one of the pair of claws 170 throughout the pivoting of the pull tab 200.

While the pull tab 200 pivots, the pair of bars 220 pass through a boundary between the terminal ends 174 of the claws 170 which are arranged to face one another above the axial portion 210. When the pull tab 200 moves across the boundary between the terminal ends 174 narrowed in its width and arranged to face one another, a friction between the pull tab 200 and the pull-tab attachment portion 160 may be minimized, thereby improving the ease of manipulation of the pull tab 200.

Specifically, a power required to pivot the pull tab 200 at an upright state is less than a power required to pivot the pull tab 200 at a laid state, in accordance with decreasing width of each claw 170 in the axial direction between the base 173 and the terminal end 174. It is expected that, for opening and closing fastener stringers, the pull tab 200 may be more often switched between the obliquely frontward orientation and the obliquely rearward orientation, rather than the pull tab 200 is completely laid down. Allowing the upright pull tab 200 to move frontward or rearward much smoothly would be beneficial.

In the laid state, the bars 220 of pull tab 200 extend along the front-rear direction. In the upright state, the bars 220 of pull tab 200 extend along the up-down direction. In the laid state, the bars 220 of pull tab 200 are laid onto the slider body 120, taking the substantially horizontal posture relative to the upper surface of the slider body 120 or taking a posture at an angle of less than 30 degrees relative to that horizontal posture. In the upright state, the bars 220 of pull tab 200 is erected on the slider body 120, taking the substantially erected posture relative to the upper surface of the slider body 120 or taking a posture at an angle of less than 30 degrees relative to that erected posture.

The power required to pivot the pull tab 200 at the laid state would be a power required to start to move the pull tab 200 which has been laid down and stationary. The power required to pivot the pull tab 200 at the upright state would be a power required to start to move the pull tab 200 which has been erected and stationary.

Note that, the pull tab 200 can hold its posture at five postures illustrated by dotted lines in FIG. 2. This is due to that the paired bars 220 of pull tab 200 grip at least one of the front and rear claws 170. Free pivoting of pull tab 200 may be avoided and relatively smooth pivoting of pull tab 200 between the slant postures may be ensured.

In some embodiments, there may be a clearance 175 between the terminal end 174 of the front-claw 171 and the terminal end 174 of the rear-claw 172. In the illustrated example, the clearance 175 extends in the left-right direction, and is elongated in the left-right direction. The clearance 175 may have a width in the front-rear direction, and this width may vary in the left-right direction. As would be understood with reference to FIG. 1, the width of clearance 175 nearby the left or right end of the axial portion 210 may be greater than the width of clearance 175 nearby the center of the axial portion 210 in the left-right direction. In other embodiments, the terminal end 174 of the front-claw 171 and the terminal end 174 of the rear-claw 172 may directly touch one another and may divide the clearance 175 into sections.

In the present embodiments, the respective claws 170 axially support the axial portion 210, and each claw 170 is held by and between the paired bars 220 of pull tab 200, furthermore the width of the claw 170 in the axial direction is reduced at the terminal end side than the base end side. Accordingly, stable axial support for the pull tab 200 may be ensured, and improved manipulation for the pull tab 200 may be achieved. It may be avoided or suppressed to precisely regulate the extent of plastic deformation of the claws 170.

Supplementation is given with respect to a method of manufacturing sliders 100. The pull tab 200 may possibly be produced through injection molding. A preform, which is a slider body 110 before the pull-tab attachment portion is swaged, may be produced through die-casting. A swaging tool, ex. punch may be utilized to swage the pull-tab attachment portion of the preform so that the pull tab 200 can be attached to the slider main body 110.

As shown in FIG. 4, the axial portion 210 of the pull tab 200 may be placed between the pre-swaged paired claws of the pull-tab attachment portion of the preform 1000 as shown in FIG. 4, and the punch 300 is driven down, thereby plastically deforming the claws due to the strike of the punch 300. If the punch 300 moves down due to gravity, the extent of plastic deformation of claws can be regulated based on the weight of the punch 300. The punching face of the punch 300 may include a half-cylindrical recessed surface elongated in the axial direction such that each claw can deform in line with that curved recessed surface.

During the swaging step of claws, it is expected that the left-right width of claws may slightly vary. That is, the left-right width of the terminal end of claws after having been swaged may be greater than the left-right width of the terminal end of claws before being swaged. In light of this aspect, the size of the claw of the preform may be determined.

After the claws have been swaged, the axial portion 210 of pull tab 200 is held at three points by the slider main body 110. That is, the axial portion 210 touches the front-claw 171, and the rear-claw 172, and a top plate 125 described below and is pressed by these contact places.

FIG. 5 illustrates a slide fastener 500 according to the present embodiment of the present invention, showing that the above-described slider has been incorporated in to the slide fastener 500. As shown in FIG. 5, the slide fastener 500 includes a pair of left and right fastener stringers 510. Each fastener stringer 510 includes a fastener tape 511 and a fastener element 512 attached to a side edge portion of the fastener tape 511. The slide fastener 500 may be a hidden slide fastener. Therefore, the fastener tape 511 may be bent and fixed to be U-shape, making it difficult to see the slider body 120 from upward. The fastener stringer 510 may further include a reinforcement tape 513 and the fastener element 512 may be sewn thereto.

A coil element is illustrated as the fastener element 512, but other types of elements may be employed. In other embodiments, resin elements may be integrally provided, through injection molding, to the side edge portion of the fastener tape.

Further discussion will be made for the configurations of the preform 1000 and the pull tab 200 with reference to FIGS. 6-12. The slider main body 110 is adapted for the hidden slide fastener. The slider body 120 includes a lower wing 121, a pair of left and right walls 122 provided at left and right side edge portions of the lower wing 121, a pair of left and right flanges 123 inwardly extending from the upper end of the wall 122 in left and right direction, a guide column 124 provided at a side of a front end of the lower wing 121, and a top plate 125 provided at the upper end of the guide column 124 and projected rearward therefrom. The pull-tab attachment portion 160, i.e. the pair of claws 170 are provided on the upper surface of the top plate 125. The upper surface of the lower wing 121 is provided with a Y-shaped partition 126 divided by the guide column 124, thereby facilitating smooth movement of left and right elements.

As would be understood by a skilled person in the art, the top plate 125 is projected rearward farther relative to the guide column 124. The top plate 125 is projected outwardly in the left-right direction farther relative to the guide column 124. The rear portion of the top plate 125 may be tapered toward the center in the left-right direction, i.e. the rear portion of the top plate 125 may include a tapered portion 125*m*. A passage for the fastener tape 511 is provided between the tapered portion 125*m* and the left or right flange 123. This feature should be immediately understood with additional reference to FIG. 5.

A pair of left and right front mouths are provided between the respective left and right walls 122 and the guide column 124 to allow in-and-out of the respective left and right elements. Upward displacement of elements may be prevented by the outward projection at the top plate 125 in the left-right direction and the flange 123. One rear mouth is provided at the rear end of the slider body 120 through which coupled left and right elements passes.

Y-shaped element passage is configured by the lower wing 121, the walls 122, the flange 123, the guide column 124, and top plate 125. Rearward movement of slider 100 renders coupled left and right elements decoupled, thereby opening the left and right fastener stringers 510. Frontward movement of slider 100 allows the decoupled left and right elements to pass by the guide column 124 so that they are coupled.

With respect to the pull tab 200, as described above, the pull tab 200 is bent at one point between the base end 201 and the free end 202. The degree of bending may be arbitrary. In some embodiments, the gripped portion 230 may be coupled to the paired bars 220 by an angle of 10 to 60 degrees. Angles within 15 to 55 degrees, 20 to 50 degrees, 25 to 45 degrees and 30 to 40 degrees would be adoptable.

In the hidden slide fastener, it might be difficult to incorporate a mechanism for controlling a posture of pull tab 200 into the slider main body 110. In the illustrated embodiments, a posture of pull tab 200 may be maintained based on the configurations of the pull tab 200 and the pull-tab attachment portion 160, which is outstanding for sliders adapted for hidden slide fasteners.

Figure 13:
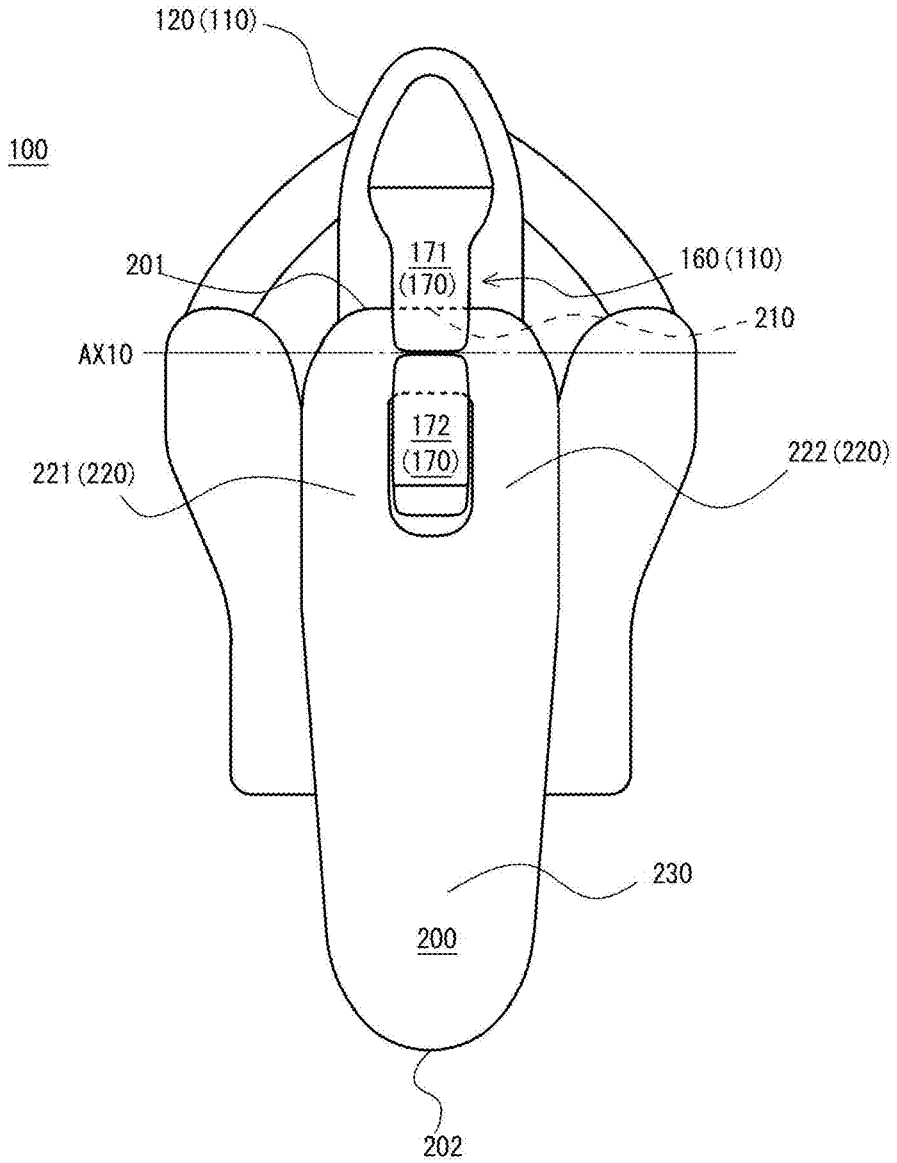
FIG. 13 is a schematic top view of a slider according to another aspect of the present invention, showing that a pull tab has been laid down rearward.
Figure 14:
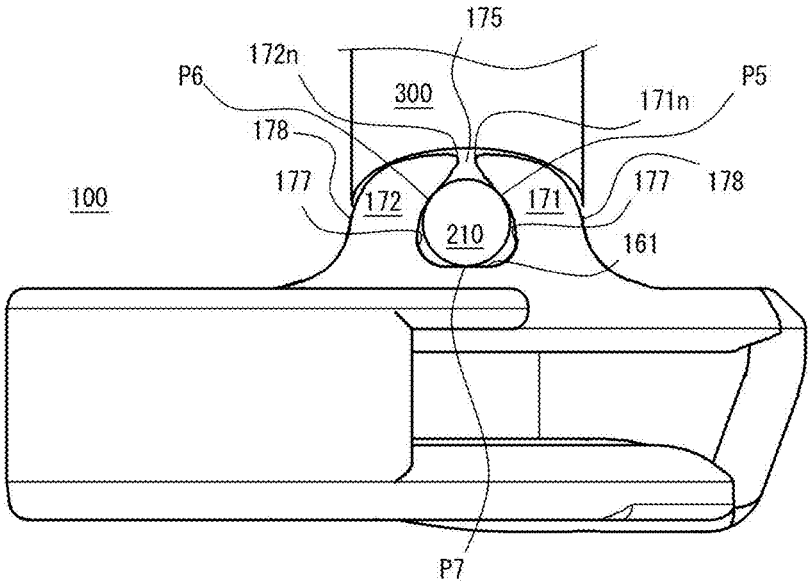
FIG. 14 shows a slider after claws have been swaged according to another aspect of the present invention.

With reference to FIGS. 13 and 14, another embodiments of the present invention will be discussed. FIG. 13 is a schematic top view of a slider, showing that a pull tab has been laid down rearward. FIG. 14 shows a slider after claws have been swaged.

In the previously described embodiments, each claw 170 was held by and between the paired bars 220 of pull tab 200. In contrast, in this latter example, each claw 170 is not be held by and between the paired bars 220 of pull tab 200. Even in these embodiments, the axial portion 210 of pull tab is held at three points of the mount surface 161 and the facing surfaces 177 of the paired claws 170, achieving that more stable pivoting posture of pull tab while the pull tab pivots may be maintained additionally to ensuring easier attachment of pull tab, similarly to the previous embodiments.

As shown in FIG. 13, the interspace between the paired bars 220 in the left-right direction is greater than the maximum width of each claw 170 in the left-right direction, and therefore each claw 170 is not held by and between the paired bars 220 while the pull tab 200 pivots. Note that, it is expected that one of the paired bars 220 may touch each claw 170, i.e. the left or right sides of each claw 170.

As shown in FIG. 14, the axial portion 210 touches the three points of the facing surface 177 of the front-claw 171, the facing surface 177 of the rear-claw 172, and the mount surface 161, thereby the axial portion 210 is retained, on the slider body 120, between the paired claws 170.

In FIG. 14, a contact point P5 between the facing surface 177 of the front-claw 171 and the axial portion 210, a contact point P6 between the facing surface 177 of the rear-claw 172 and the axial portion 210, a contact point P7 between the mount surface 161 and the axial portion 210 are schematically illustrated. The respective contact points P5-P7 are arranged in the circumferential direction surrounding the axial portion 210 with equivalent angular intervals. Namely, the respective contact points P5-P7 may be substantially arranged in the circumferential direction with angular intervals of 120 degrees. If there are too many contact points, then there may be a rink of increased friction against the pivoting of pull tab 200. A skilled person in the art would appreciate the benefit of this illustrated retaining at three-points.

Note that, in illustrated examples of FIGS. 13 and 14, W173<W220 is satisfied in which W173 indicates a left-right width of the base 173 of the claw 170, and W220 indicates an interspace between the paired bars 220 of the pull tab 200 in the left-right direction. Furthermore, W174<W220 is satisfied in which W174 indicates a width of the terminal end 174 of the claw 170 in the left-right direction, and W220 indicates an interspace between the paired bars 220 of the pull tab 200 in the left-right direction.

Based on the above teachings, a skilled person in the art could add various modifications to the respective embodiments. The reference numbers added to Claims are solely for a reference and should not be utilized for the purpose of narrowly construing the claimed scope.

REFERENCE SIGNS LIST

100 Slider
110 Slider Main Body
120 Slider Body
160 Pull-tab Attachment portion
170 Claw
200 Pull tab
210 Axial portion
220 Bar

The invention claimed is:

1. A slider for slide fastener comprising:
a slider body;
a pull-tab attachment portion provided at the slider body;
a resin-made pull tab attached to the pull-tab attachment portion, the pull tab including an axial portion and a pair of left and right bars extending from respective ends of the axial portion, wherein
the pull-tab attachment portion includes a pair of front and rear claws that axially support the axial portion of the pull tab,
the front and rear claws are held by and between the left and right bars while the pull tab pivots so that contact of the respective claws with the left and right bars is maintained throughout the pivoting of the pull tab, and
a width of a terminal end of each claw in an axial direction of the axial portion is less than a width of a base end of each claw in the axial direction.

2. The slider according to claim 1, wherein the pair of left and right bars grip one or both of the pair of front and rear claws throughout the pivoting of the pull tab.

3. The slider according to claim 1 wherein, while the pull tab pivots, the pair of left and right bars pass through a boundary between the terminal ends of the front and rear claws which are arranged to face one another above the axial portion.

4. The slider according to claim 1 wherein the pair of left and right bars are arranged to have a first interspace, and the width of the terminal end of each claw in the axial direction is less than the first interspace.

5. The slider according to claim 1, wherein a power required to pivot the pull tab at an upright state is less than a power required to pivot the pull tab at a laid state, in accordance with decreasing width of each claw in the axial direction between the base end and the terminal end.

6. The slider according to claim 1, wherein a width of each claw in the axial direction continuously decreases from the base end toward the terminal end of each claw.

7. The slider according to claim 1, wherein each terminal end of each claw has a first corner which is rounded and is positioned at a side of a first end of the axial portion of the pull tab, and a second corner which is rounded and is positioned at a side of a second end of the axial portion of the pull tab.

8. The slider according to claim 1, wherein the slider body comprises:
a lower wing;
a pair of left and right walls provided at left and right side edge portions of the lower wing;
a pair of left and right flanges inwardly extending from the upper end of the wall in left and right direction;
a guide column provided at a side of a front end of the lower wing; and
a top plate provided at the upper end of the guide column and projected rearward therefrom, wherein
the pull-tab attachment portion is provided on the top plate.

9. The slider according to claim 1, the pull tab further comprises a gripped portion to which the left and right bars are coupled, wherein the gripped portion is provided in a non-planar manner so as to be angled relative to an extending direction of the left and right bars.

10. A slide fastener comprising:
a pair of left and right fastener stringers in which fastener elements are provided at side edge portions of fastener tapes; and
a slider of claim 1 for engaging and disengaging the left and right fastener elements.

11. A slider for slide fastener comprising:
a slider body;
a pull-tab attachment portion provided at the slider body;
a resin-made pull tab attached to the pull-tab attachment portion, the pull tab including an axial portion having a circular cross section and a pair of bars extending from respective ends of the axial portion, wherein
the pull-tab attachment portion includes a pair of claws that are arranged to face one another in order to axially support the axial portion of the pull tab, and a mount surface provided between the paired claws and onto which the axial portion is placed, and wherein
the axial portion is held at three points of facing surfaces of the respective paired claws and the mount surface so as to maintain contact of the axial portion with said three points throughout the pivoting of the pull tab, allowing the pull tab to be positioned at any angle relative to the slider body.

12. A slider for slide fastener comprising:
a slider body;
a pull-tab attachment portion provided at the slider body;
a resin-made pull tab attached to the pull-tab attachment portion, the pull tab including an axial portion and a pair of left and right bars extending from respective ends of the axial portion, wherein
the pull-tab attachment portion includes a pair of front and rear claws that axially support the axial portion of the pull tab, and wherein
the pair of left and right bars grip one or both of the front and rear claws throughout the pivoting of the pull tab so as to maintain contact of the respective claws with the left and right bars throughout the pivoting of the pull tab.

13. The slider according to claim 12, wherein a terminal end of each claw is held by and between the left and right bars of the pull tab.

14. The slider according to claim 12, wherein the pull tab is elongated in a direction away from the axial portion, and has an opening in which an opening width is defined by the pair of left and right bars.

15. The slider according to claim 12, wherein the pull tab is bent at one point between a base end thereof and a free end thereof.

16. A slider for slide fastener comprising:
a slider body;
a pull-tab attachment portion provided at the slider body;
a resin-made pull tab attached to the pull-tab attachment portion, the pull tab including an axial portion and a pair of bars extending from respective ends of the axial portion, wherein
the pull-tab attachment portion includes a pair of claws that axially support the axial portion of the pull tab, and wherein
the axial portion is surrounded by the pair of claws and a surface extending between the pair of claws such that the axial portion is elastically deformed.

17. The slider according to claim 16, wherein the surface extending between the pair of claws is upwardly positioned from an upper surface of the slider body.

18. The slider according to claim 16, wherein the surface extending between the pair of claws matches an upper surface of the slider body.

19. The slider according to claim 16, wherein the thickness of the claw is reduced at the side of a terminal end of the claw.

20. The slider according to claim 16, wherein a clearance is provided between the paired claws.

21. The slider according to claim 16, wherein the pair of claws include a front-claw and a rear-claw, and wherein the front-claw includes a surface region that approaches closer to the rear-claw as extending upward, and the rear-claw includes a surface region that approaches closer to the front-claw as extending upward.

* * * * *